US005232028A

United States Patent [19]

Sunderhaus et al.

[11] Patent Number: 5,232,028

[45] Date of Patent: Aug. 3, 1993

[54] VAPOR RECOVERY DROP TUBES

[75] Inventors: Charles A. Sunderhaus, Hamilton; David R. Pendleton, Fairfield, both of Ohio

[73] Assignee: Dover Corporation, New York, N.Y.

[21] Appl. No.: 902,684

[22] Filed: Jun. 22, 1992

[51] Int. Cl.[5] ..... B65B 1/04; B65B 3/04

[52] U.S. Cl. ..... 141/301; 141/302; 141/286; 141/291; 141/292; 220/86.1; 137/588; 137/594; 277/207 A; 285/24

[58] Field of Search ..... 141/301, 302, 285, 286, 141/86, 87, 88, 290, 291, 292, 295, 296; 220/366, 367, 745, 86.1, 86.2; 137/588, 594, 614.03, 614.05; 277/106, 177, 207 A; 285/24, 27, 31, 301; 138/155; 251/149.1, 149.6, 85, 86

[56] References Cited

U.S. PATENT DOCUMENTS

| | | | |
|---|---|---|---|
| 2,735,701 | 2/1956 | Ecker et al. | 277/177 |
| 2,840,336 | 6/1958 | Suthann | 251/85 |
| 2,911,238 | 11/1959 | Myers et al. | 285/301 |
| 4,896,705 | 1/1990 | Podgers et al. | 220/86.1 |
| 4,958,957 | 9/1990 | Berg et al. | 220/86.1 |

*Primary Examiner*—Henry J. Recla

*Assistant Examiner*—Steven O. Douglas

*Attorney, Agent, or Firm*—Kinney & Schenk

[57] ABSTRACT

A drop tube/adapter unit, mounted on the riser pipe of a fuel storage tank, defines a fuel inlet path and an annular vapor return path during a loading operation. A vapor valve, provided in the vapor return path, prevents escape of vapors when a loading operation is not taking place. The drop tube is mounted for universally pivotal movement relative to a vapor valve member thereon, so that the vapor valve will reliably close, if the riser tube is out of plumb. A spring urges the drop tube, valve member to a closed position through a spring support. A stop means engages the spring support and precompress this spring, with the spring support positioned to facilitate its attachment to the adapter. The spring support is attached to the adapter by a threaded connection, comprising a threaded portion at the lower end of the adapter. This threaded portion is interrupted by a recess which positions a ring for sealing the adapter to the upper end of the riser pipe, when the adapter is threaded onto the riser pipe. A fixed angular relation between the adapter and the drop tube is achieved through the use of a locator ring to obtain a desired disposition of an drop tube overfill valve.

19 Claims, 6 Drawing Sheets

VAPOR RECOVERY DROP TUBES

The present invention relates to improvements in drop tubes through which volatile liquids are discharged into a storage tank and more particularly to drop tubes having a coaxial passage for the recovery of vapors displaced from the storage tank, as it is filled with liquid.

It is now generally recognized that hydrocarbon vapors are a significant source of air pollution. A predominant source of such vapors is found in the transfer of gasoline, and other petroleum based fuels, to and from storage tanks for ultimate discharge of fuel into the fuel tank of a vehicle. The present invention is directed to minimizing fuel vapor pollution and more specifically to minimizing, if not eliminating, thermal changes as a cause of vapor pollution in storage tanks systems from which fuel is drawn to fill the fuel tanks of vehicles, as at retail filling stations.

It is an accepted and widespread practice to employ a motorized tank car to deliver bulk quantities of gasoline and other fuels to a retail filling station. The fuel is then discharged from the tank car into a storage tank, which, in most cases, is buried beneath in the ground. More specifically, it is a widespread practice provide a riser pipe, projecting upwardly from the underground storage tank, which terminates beneath the level of a concrete apron. The upper end of the riser pipe is accessible by way of a manhole. A hose is then employed to effect a fluid connection between the tank car and the storage tank. This is done by attaching a hose coupling to an adapter mounted on the upper end of the riser pipe.

As the storage tank is filled, fuel vapor is displaced therefrom. The initial step toward minimizing this source of air pollution was to provide means for capturing the displaced vapor and returning it to the tank car. The vapor in the tank car is then later condensed, or otherwise disposed of, to the end that it does not escape into the atmosphere.

The end of returning vapors to the tank car has been obtained through the use of a drop tube, mounted on the adapter, and defining an outer, coaxial, annular chamber in combination with the riser pipe. The hose coupler comprises means for effecting a sealed connection with the drop tube for the discharge of fuel therethrough and into the storage tank. The hose coupler also includes means for connecting the annular vapor return passage to conduit means which extend back to the interior of the tank car.

In a further effort to minimize this source of air pollution, is has also be proposed, and become an accepted practice to provide a valve at the upper end of the vapor return flow path. More specifically, this valve has comprised an annular sealing ring between the upper end of the drop tube and the adapter. The purpose of this valve is to permit the flow of vapor when the hose coupler is connected thereto and to prevent the escape of vapors when the hose coupler is disconnected therefrom. This brings out the fact that, except during a filling operation, the upper end of the riser pipe is sealed by a removable cap. The valve prevents escape of vapors while this cap is removed.

The drop tube is yieldingly mounted relative to the riser pipe. Thus, in attaching the hose coupler to the riser adapter, the drop tube is displaced downwardly to open the vapor valve. The vapor valve also prevents escape of vapor in the event that there is a failure to mount the sealing cap after completing a filling operation, or in the event that the sealing cap is not properly engaged with the adapter.

The problem which the present invention addresses is to overcome the difficulties which exist in reliably obtaining a sealing action by this vapor valve. Such difficulties stem from the fact that the riser pipe has a four inch diameter and a length of as much as four feet, and sometimes more, dependent on the depth to which the storage tank is buried. The drop tube extends to a point adjacent the bottom of the tank and has a length of something in the order of twelve feet, or more, dependent on tank height and the depth to which it is buried. It is also to be recognized that the tank itself is quite bulky.

All of these factors make it difficult, if not impossible, in an economically practical sense, to dispose the riser pipe in an upright, vertically "plumb" position. Even if a vertically "plumb" position is initially obtained, over a period of time, settling of the subsoil can cause the storage tank to shift so that the riser pipe tilts from its "plumb" position.

This is not over to exaggerate the problem of maintaining a "plumb" position, inasmuch as it is normally possible to install a storage tank and riser pipe so that the riser pipe is no more than one to two degrees out of "plumb". However, because of the large dimensions involved, even a relatively small tilting of the drop tube, relative to the riser pipe, can result in significant leakage of vapor because of a failure of the surfaces of the valve sealing members to completely seat.

Accordingly, one object of the present invention is to overcome the problems of obtaining a vapor seal in such drop tube assemblies, where the riser pipe is not "plumb".

Vapor valves of the type herein contemplated employ a highly compressed spring to provide for a yieldable mounting of the drop tube. This makes it difficult to assemble the valve components with the adapter, and further complicates mounting the adapter on a riser pipe and obtaining a sealed connection therewith.

Accordingly, another object of the present invention is to facilitate assembly of the valve components of a drop tube/adapter and in obtaining a sealed connection between the adapter and a riser pipe.

Other objects of the invention include preventing leakage of vapor at the connection between a riser pipe and the referenced adapter.

Also included is the object of maintaining a desired angular relationship between the riser pipe and the drop tube. This end relates to the provision of an automatic shut off valve for preventing the storage tank from being overfilled. Such valves are mounted, on the drop tube, within and adjacent the upper end of the storage tank. A preferred form of such shut off valve employs a float that pivots to a horizontal position in order to provide the shut off function. The normal storage tank is cylindrical in configuration. In order that the tank be filled to a maximum level, it is desired that this float be deployed and swing in a plane generally parallel to and vertically aligned with the axis of the cylindrical storage tank.

In accordance with one aspect of the invention, the foregoing ends are broadly attained by a vapor valve, in the above environment, which comprises a first valve member on an adapter and a second valve member on a drop tube, with yieldable means for maintaining the second valve member in engagement with the first valve member, in its closed position. The drop tube is universally pivotally mounted relative to the second valve member. Thus, if the riser pipe is out of plumb, the first and second valve members will be maintained in seated relation in the closed position of the vapor valve.

In a preferred form, the second vapor valve member comprises an annular ring having a bore greater than the outer diameter of the drop tube and an O-ring seal is provided between this bore and the drop tube.

In accordance with another aspect of the invention the foregoing ends are attained by a drop tube and adapter unit intended to be mounted on a riser pipe extending upwardly from a liquid storage tank. The adapter has, at its lower end, a threaded portion for mounting the adapter/drop tube unit on a riser pipe. The drop tube defines a fuel flow path for loading of liquid into the storage tank. The drop tube, adapter and riser pipe define an annular vapor return flow path for returning vapors from the tank to a collection means, when a loading coupler is mounted on the adapter. A vapor valve is disposed in the vapor return flow path and comprises a first valve member on the adapter and a second valve member on the drop tube. The drop tube is axially movable relative to the adapter and riser pipe. Yieldable means urge the drop tube to a position bringing the second valve member into sealing engagement with the first valve member in a closed position of the vapor valve. The yieldable means comprise a compression spring and a spring support. The drop tube is displaceable to a position in which the vapor valve is open, when a loading coupler is mounted on the adapter. Means are provided for positively securing the spring support on the adapter in fixed relation to the first valve member. A recess, disposed between the threaded portion and the spring support, is provided to position a sealing ring which will be compressed between the spring support and the upper end of the riser pipe, when the adaptor is mounted thereon. An additional feature is found in providing a positive seal between the spring support and the adapter.

In accordance with another aspect of the invention, the foregoing ends are attained by a drop tube and adapter adapted to be assembled and then mounted on a riser pipe extending upwardly of a liquid storage tank to provide a central liquid flow path for loading liquid into the storage tank and an annular vapor return flow path for liquid displaced from storage tank, and further to provide a vapor valve for sealing the vapor return flow path when a loading operation is not in progress. The vapor valve comprises a first valve member on the adapter and a second member mounted on the drop tube. Spring means are disposed beneath the second valve member. A spring support is disposed beneath the spring means. Means are provided for securing the spring support to the adaptor with the second valve member urged upwardly into sealing engagement with the first valve member by the spring means. Means are provided for precompressing the spring means and positioning the spring support for engagement of the means for securing the spring support to the adapter.

Other features of the invention are found in the provision of locating means which prevent rotation of the drop tube relative to the riser pipe. In accordance with method aspects of the invention, the drop tube is inserted through the riser pipe and loosely secured thereon by threading the adapter thereon. The drop tube is then rotated to a desired angular position, in which the float of an overfill valve is aligned with the axis of a cylindrical storage tank. Locating means are provided for maintaining this angular relation between the drop tube and the riser pipe, when the adapter is rotated to secure it in fixed relation to the riser pipe. The locating means comprise a member projecting outwardly from the drop tube and received in a guideway, which is in fixed relation to the riser pipe, after the adapter is secured in fixed relation thereon.

The above and other related objects and other related objects and features will be apparent from a reading of the following description of a preferred embodiment, with reference to the accompanying drawings, and the novelty thereof pointed out in the appended claims.

IN THE DRAWINGS

Figure 1:
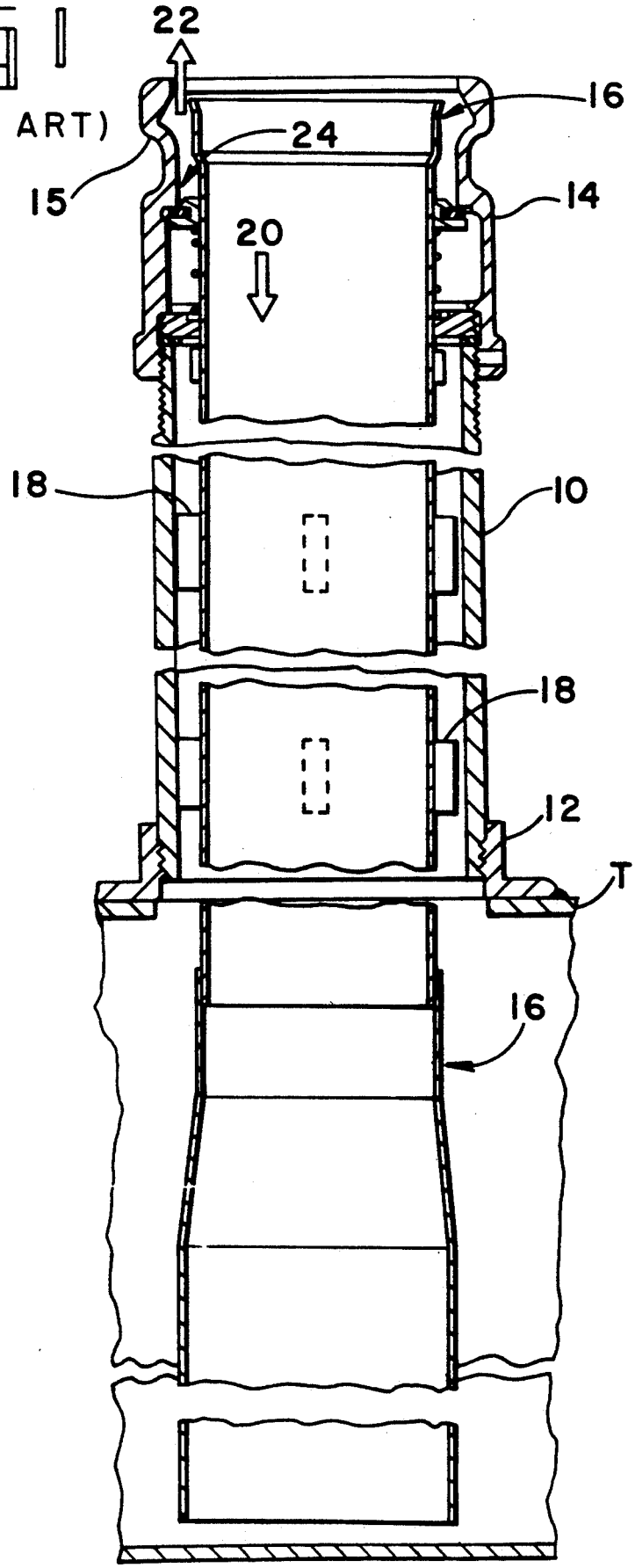
Fig 1 (PRIOR ART)
FIG. 1 is an elevation, in longitudinal section, of a prior art drop tube, of the type herein referenced, in its installed relation on an underground storage tank.

Reference is first made to FIG. 1 for a description of the environment in which the present invention is employed and the shortcomings of the prior art.

As indicated above, the present invention deals broadly with loading of fuels, or other volatile liquids, into a storage tank, and more specifically into buried, underground storage tanks, as the tank T. Typically, such tanks comprise a riser pipe 10, which is threadably secured to a bung flange 12, on the upper surface of the tank T. An adapter 14 is mounted on the upper end of the riser pipe 10. The adapter cooperates with a standard coupler to permit a conduit connection for loading fuel into the tank T. After a loading operation is complete, a cap is secured to the adapter 14 to seal the upper end of the riser pipe 10. The under cut surface 15 is of a standard configuration for engagement by toggle links in the mounting of a cap or coupler thereon.

A typical tank T has a diameter in the order of seven feet and is usually buried to a depth such that its upper surface is four to five below ground level (see also FIG. 6, which is not to scale). The riser pipe has a height of three to four feet. Its upper end portion is typically disposed within a containment device D, which prevents contamination of the soil by fuel spilled during a loading operation. The adapter 14 is disposed, within the containment device, below ground level, so that a containment device cover, at ground level, can be put in place after each loading operation.

A drop tube 16 is mounted on the adapter 14 and extends downwardly, through the riser pipe 10, to a point adjacent to and spaced above the bottom to the tank T. The drop tube 16 is conventionally formed by an upper section which extends within the tank T and then a lower section or sections, which may be selected to match the diameter of the tank.

Two sets of four, angularly spaced lugs 18, mounted on the portion of the drop tube 16, within the riser pipe 10, maintain the drop tube 16 in spaced relation with the riser pipe 10 in event the riser pipe is significantly out of plumb.

Typically the riser pipe has a diameter in the order of four inches and the drop tube has a diameter, at its upper end, in the order of 3½ inches. The length of the drop tube is in the order of ten to eleven feet.

The interior of the drop tube 16 defines a fuel flow path 20. When a loading coupler (not shown) is mounted on the adapter 14, a sealed connection is made between the upper end of the drop tube 16 and fuel conduit means in the loading connecter, which are then placed in communication, through a hose, to a fuel transport truck. Valve means at the truck may be employed to control the amount of fuel discharged into the storage tank.

The drop tube 16, in combination with the riser pipe 10 and adapter 14, also defines an annular vapor return path 22 for fuel vapors displaced from the tank T during a loading operation. The loading connector, when mounted on the adapter 14, comprises passageway means which are placed in sealed communication with the vapor return flow path 22. Further passageway means direct vapors, displaced from the tank T, back to the transport tank to the end that the vapors are captured and not dispersed to pollute the atmosphere.

The referenced loading coupler, which provides connections with fuel flow path 20 and vapor return path 22, is well known, as are the means for loading fuel from the transport truck and returning fuel vapors thereto. Such couplers have standardized configurations. The configurations of the adapter 14 and drop tube 16 are adapted to cooperate with such standard loading coupler configurations in making the described connections therebetween.

The adapter 14/drop tube 16 also comprises a valve 24 for the vapor flow path. The valve 24, shown in greater detail in FIG. 2, comprises an elastomeric ring 26, which is supported by a seal seat 28 that is secured, by welding, to the outer diameter of the drop tube 16. The ring 26 is engageable with an annular seat 30 formed interiorly of the adaptor 14.

A spring 32 is coiled about the drop tube 16 between the seal seat 28 and a spring support 34. The spring support 34 is clamped against inwardly projecting flange 36, on adapter 14, through sealing ring 38, which is clamped against the upper end of riser pipe 10 in threading the adaptor 10 onto the riser pipe.

Assembly of these components and their mounting on the riser pipe 10 will be briefly noted. The seal seat 28 is welded to the drop 16 and the ring 26 mounted thereon. The spring 32 and spring support 34 are then telescoped upwardly from the lower end of the upper portion of the drop tube 10 (before attachment of the larger diameter, lower drop tube extension). The spring 32 is compressed by threading the spring support upwardly of a threaded portion 52 in the lower end of the adapter 14. The spring support 34 is thus positioned in a recess 54 above the threaded portion 52. A sealing ring 38 is then positioned in the recess 54, beneath the spring support 34.

The lower portion of the drop tube is then attached to the upper portion and inserted through the riser pipe 10 for positioning in the storage tank T. Assembly is then completed by rotation of the adapter 14 onto the riser pipe 10. Considerable difficulty has been experienced in maintaining the integrity of the sealing ring 38 in this mounting operation.

The drop tube 16 is thus yieldably mounted, in a vertical, axial direction, relative to the adapter 14. The vapor seal 24 is thereby, normally urged to its closed position.

When a loading coupler is secured to the adapter 14, the fuel passage component of the loading coupler sealingly engages the upper end of the drop tube 16 and displaces it downwardly to open the vapor valve 24 and thus provide for return flow of vapor during a loading operation. When the loading operation is completed, the loading coupler is removed from the adapter. When this is done, the spring 32 raises the drop tube 16 to close the valve 24 and thereby prevent escape of vapors from the vapor return path 22. After removal of the loading coupler, a cap, of known design, may be secured to the adapter 14 to prevent dirt from entering the drop tube. The design of such caps is such that the drop tube will not be displaced, so that, with the cap in place, it is intended that primary prevention of the escape of vapors is provided by the valve 24, and that secondary protection be provided by the cap's engagement with the adapter 14.

In theory, the above described means for providing the vapor return valve 24 is effective for its intended purpose. However, in practice, it has been found that there is a leakage of vapors past the valve 24. This shortcoming has been identified as being due to the large size of the components, primarily as related to obtaining a vertical, plumb orientation of the riser pipe 10.

Figure 2:
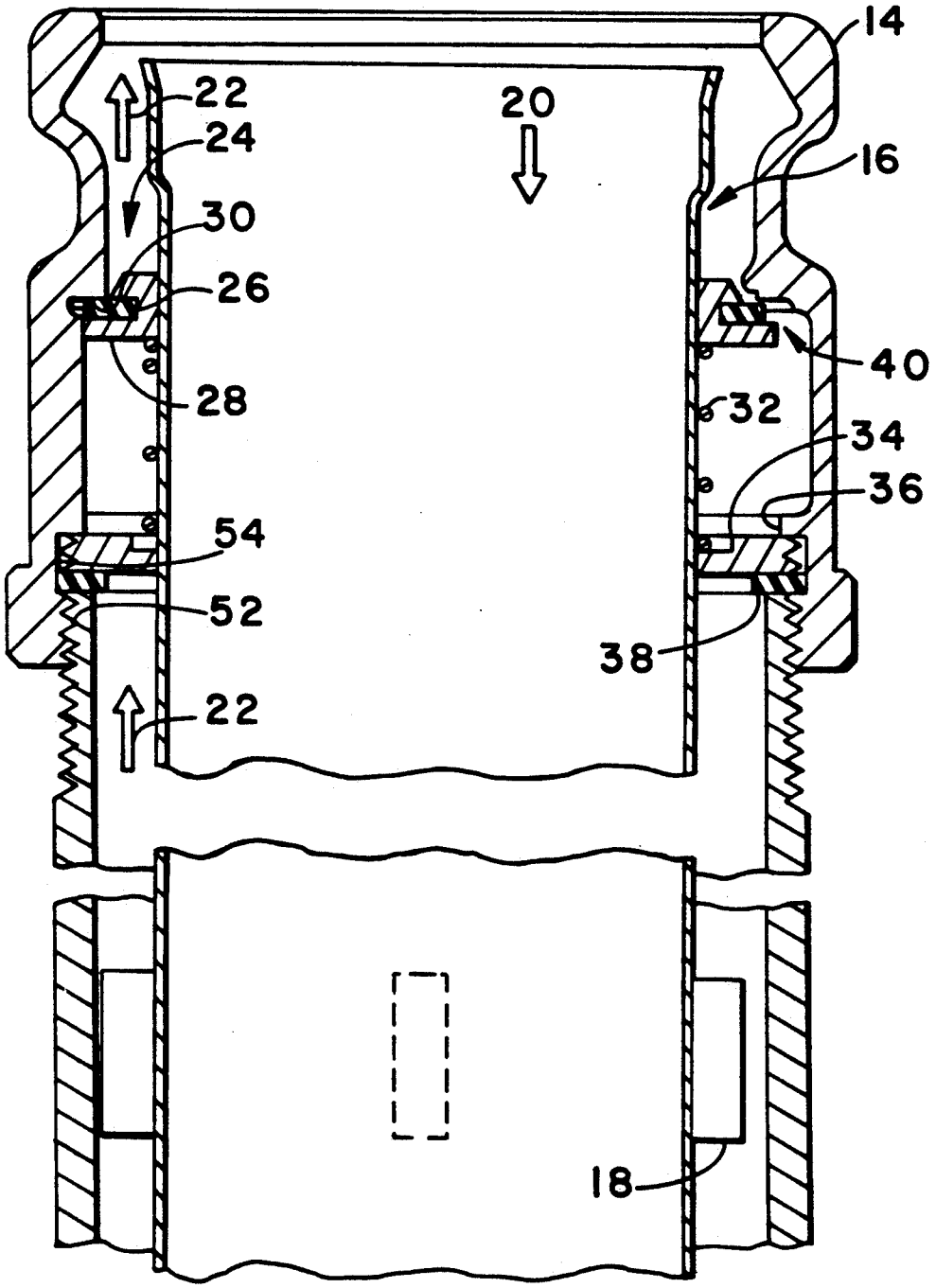
Fig 2 (PRIOR ART)
FIG. 2 is a view, on an enlarged scale, of the upper end portion of the drop tube seen in FIG. 1.

When a plumb orientation of the riser pipe 10 is not obtained, the axis of the drop tube 16 will be angled relative to the axis of the riser pipe 10, as is best seen in FIG. 2. When this occurs, the sealing ring 26 will be angled relative to the valve seat 30, on adapter 14. This angled relation creates a leakage flow path, which is indicated at 40.

While it would be theoretically possible to seat the ring 26 against the seat 30 through the use of a stronger spring 32, such solution is impractical because of the mass of the drop tube.

It would also be possible to overcome this misalignment problem by providing a sliding guideway between the drop tube 16 and the adapter 14 and/or the riser pipe 10. Again, because of the large mass of the drop tube 16, this approach is economically impractical. It is to be noted that the lugs 18 are provided to limit angular movement of the drop tube 16 and the riser pipe 10, particularly during installation, for purposes of minimizing damage to the drop tube components. It is to be further noted, that conventional storage tank installation procedures enable a tank to be installed in a buried condition with the riser pipe no more than a few degrees out of plumb, generally 1°–2°. The lugs 18 limit the relative angular relation of the drop tube 16 to the riser pipe 10 to this range of 1° to 2°. There will thus be little of no frictional forces between the lugs 18 and the riser pipe 10, which would impede axial movement of the drop tube 16, particularly in its being displaced upwardly, by spring 32, to close the valve 24.

The illustrated, prior art adapter/drop tube unit also has a further shortcoming in that it is difficult to reliably obtain an effective seal between the adapter 14 and the riser pipe 10.

IMPROVED CONSTRUCTION

Figure 3:
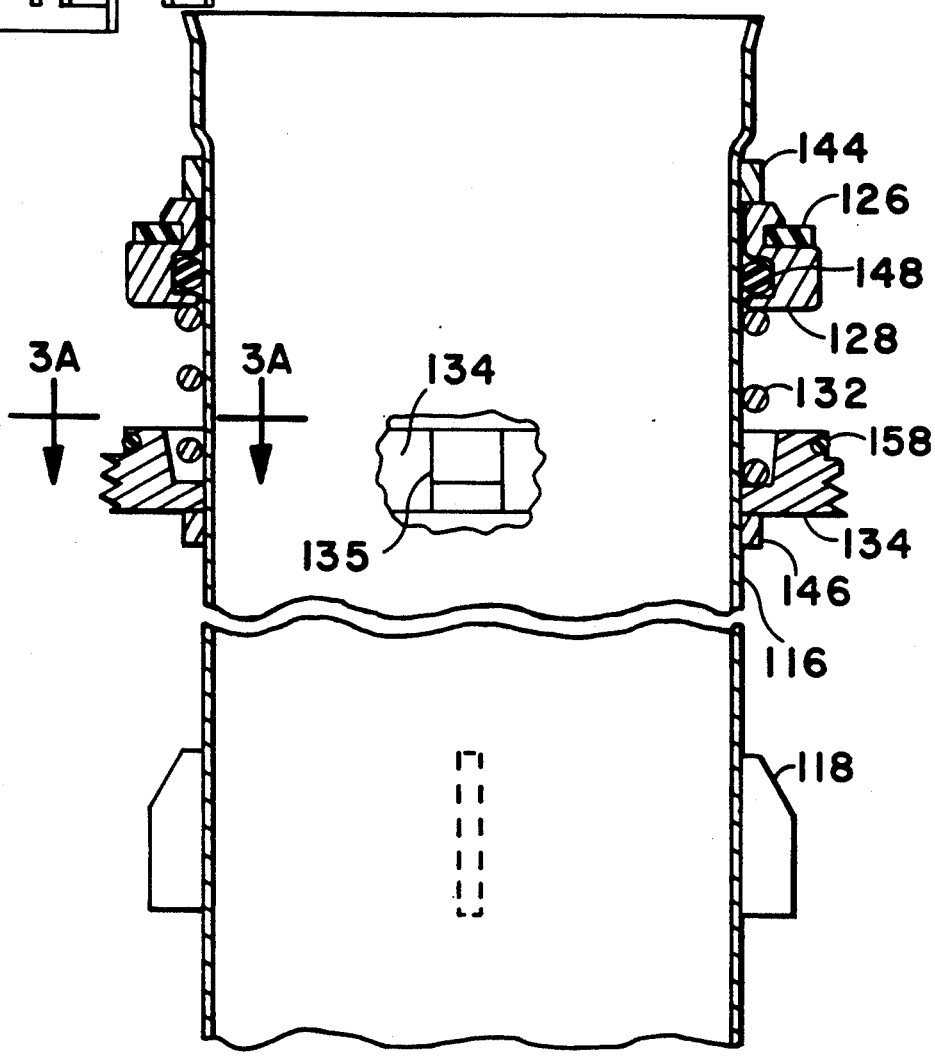
FIG. 3 is a view, in longitudinal section, of a drop tube embodying the present invention.

Reference is next made to FIG. 3, which illustrates a drop tube 116, more specifically the upper portion of a drop tube, to which a lower extension may be attached. The drop tube 116 has spacing lugs 118 as above described. A valve seal seat 128 is mounted on the tube 116 and is urged upwardly by a spring 132 against a stop ring 144 that is welded onto the tube 116. The lower end of the spring 132 is seated on a spring support 134, which engages a second ring 146 also welded on the tube 116. These components are assembled by first welding the stop ring 144 on the tube 116. The seat 128, spring 132 and spring support 134 are then telescoped over the tube 116 and the spring 132 compressed, or precompressed, bringing the support 134 to or above its illustrated position. The stop ring 146 is then telescoped over the tube 116 and welded to the tube.

The described sub-assembly can be economically assembled at a shop facility, employing fixtures which minimize the time and effort required.

Figure 3A:
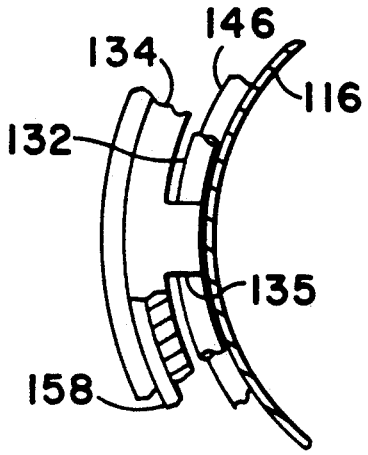
FIG. 3A is a section taken on line 3A—3A in FIG. 3.

Reference is made to FIG. 3A which illustrates that the main, inner diameter of the spring support 134 is spaced from the drop tube 116 and that the support function is provided by inwardly projection recessed lugs 135, closely spaced from the drop tube 116. This, as will later be apparent, enables the vapor flow path 22 to pass through the spring support 134. (The provision of such support lugs is also found in the embodiment of FIG. 2.)

It is to be noted that the seal seat 128 has an inner diameter greater than that of the tube 116 to permit limited, universal angular movement of the seal seat 128 relative to the tube 116. An O-ring 148 is disposed between the bore in the seal seat 128 and the drop tube 116 to provide a fluid seal therebetween. An elastomeric valve seal ring 126 is mounted on the seal seat 128.

Figure 4:
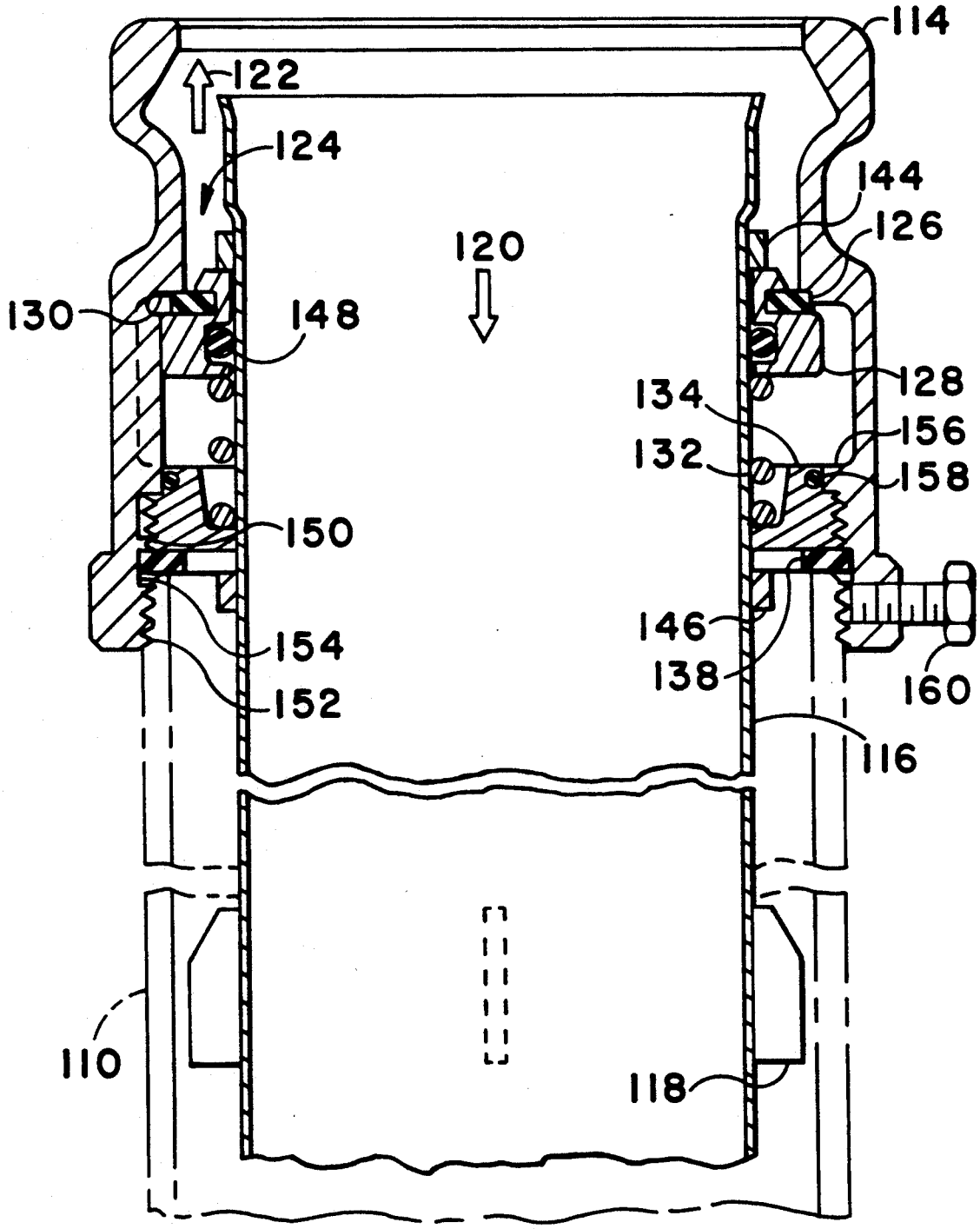
FIG. 4 is a view, also in longitudinal section, illustrating the drop tube of FIG. 3 assembled with an adapter embodying the present invention.

The described subassembly of FIG. 3 is then assembled with an adapter 114, as illustrated in FIG. 4. The general configuration of the adapter 114 corresponds to that of the prior art adapter 14, particularly as regards its interrelationship with the loading coupler and the seal cap, which is used when a loading operation is not taking place.

The adapter 114 is distinguished by spaced threaded portions 150, 152 at its lower end and a recess 154 therebetween. Assembly of the adapter 114 is accomplished by first telescoping the adapter 114 over the upper end of the drop tube 116. The spring support is then threaded into the lower threaded portion 152, with threading being continued until the portion 150 is engaged. It will be noted that the height of the recess 154 is, preferably, less than the height of the threaded portion of the spring support 134 so that the support may readily engage the upper threaded portion 150. This end is obtained by tapping the threaded portions 150, 152 in a single operation and then forming the groove 154. The threaded portion 150 is thus a continuation of the threaded portion 152.

As the support 134 is threaded into the adapter 114, the seal ring 126 engages a valve seat 130 formed on the adapter 114. Continued rotation of the spring support 134 advances the spring support upwardly to engage it with the bottom surface of an inwardly projecting, circumferential rib 156. The spring support 134, by being sufficiently rotated, is locked in this assembled position, in which the spring 132 is further compressed and the spring support 134 is positioned above the threaded portion 152.

It is to be noted that the spacing between the stop rings 144, 146 is short enough for the spring support 134 to engage the threaded portion 154, before the sealing ring 126 engages the adapter seat 130 and yet great enough for the spring support 134 to further compress the spring 132 and bring the sealing ring into engagement with the seat 130.

This drop tube assembly further distinguishes the prior art drop tube assembly in that there is a positive seal between the spring support 134 and the adapter 114. This seal is provided by an O-ring 158, which is disposed in a groove formed in an upper, cylindrical portion of the spring support 134. As the spring support 134 is threaded into assembled relation with the adapter 114, its upper end is telescoped within the circumferential rib 156 and the O-ring 158 effects a positive seal therewith.

The assembled drop tube 116 and adapter 114 are then readily mounted on a riser pipe 110 simply by lowering the drop tube 116 (after attachment of the lower portions thereof) through the riser pipe 110. Before this is done, a sealing ring 138 is inserted into the recess 154, which is dimensioned to prevent the ring 138 from freely falling therefrom. Mounting is completed by simply rotating the adapter 116 to engage the threaded portion 152 with threads formed on the upper end of the riser pipe 110. When the adapter 114 has been properly torqued, one or more screws 160 may be tightened to prevent inadvertent unthreading of the adapter 114 from the riser pipe 110.

The drop tube 116/adapter 114, as illustrated in FIG. 4 defines a fuel flow path 120, vapor flow path 122, in combination with the riser pipe 110, and vapor valve 124, which provide the basic functions of the corresponding components of the prior art device, previously described. Improved operation is found in that an effective seal is provided by the vapor valve 124, where the riser pipe is out of plumb.

FIG. 4 illustrates the riser pipe in a plumb orientation, with the weight of the drop tube 116 carried by the stop ring 144, which is supported by the relatively fixed seal seat 128 (by reason of engagement or the sealing ring 126 with the adapter seat 130, under the influence of spring 132). If the riser pipe 110 is angled from a plumb position, the drop tube 116 is free to pivot relative to the seal seat 128, by reason of the clearance between the drop tube 116 and the bore of the annular seal seat 128. The sealing ring 126 is maintained in sealing engagement with the adapter seat 130 by the spring 132. It is to be noted that this sealing action, between the ring 126 and seat 130 can be obtained without increasing the spring force of the spring 132. It will be apparent that the O-ring 148 provides a vapor seal between the seal seat 128 and the drop tube 116 to permit a change in the angular relationship therebetween, without any adverse affect on the integrity of the vapor valve 124. The drop tube 116 is thus mounted for limited, universal movement relative to the vapor valve 124.

It will also be appreciated that the seal provided by O-ring 158 is a positive seal against vapor leakage and more reliable than the sealing action that is available from engagement of spring support threads with the threaded portion 150 and/or the sealing action available between the riser pipe threads with the threaded portion 152, and/or the sealing action available from engagement of the sealing gasket 138 with the adapter 114.

The construction of FIGS. 3 and 4 thus overcomes the problem of providing a reliable valve for the vapor return flow path where the riser pipe of a storage tank is out of plumb, within the limits economically achievable in the installation of underground storage tanks.

This construction provides further economies in that precision in the construction and machining of its components is not required. This is to point out that the critical relationship is obtaining a parallel relation between the seal 126/seal seat 128 and the adapter seat 130. In the prior art design, if the seal seat 28 was not at right angles to the axis of the drop tube 16, the weight of the tube would angle the seal ring 26 relative to the seat 30, tending to create a leakage flow path. If stop ring 144 is not at a precise right angle to the axis of the drop tube 116, the affect will be the same as if the riser pipe is not plumb. That is the riser pipe 116 will simply be angled relative to the seal seat 128 and the seal ring 126 will be maintained in sealing engagement with the seat 130.

In a broader sense, the vapor valve 124 comprises a first valve member (130) and a second valve member (compositely provided by the seal seat 128 and ring 126) on the drop tube (116). Yieldable means (spring 132) maintain these valve members engaged in the closed position of the vapor valve. The drop tube is universally, pivotally mounted relative to the second valve member to the end that the integrity of the vapor valve will not be affected in the event that the riser pipe is out of plumb within limits normally to be expected in the installation of liquid storage tank and more specifically, fuel storage tanks as installed in retail, fuel service stations.

Figure 6:
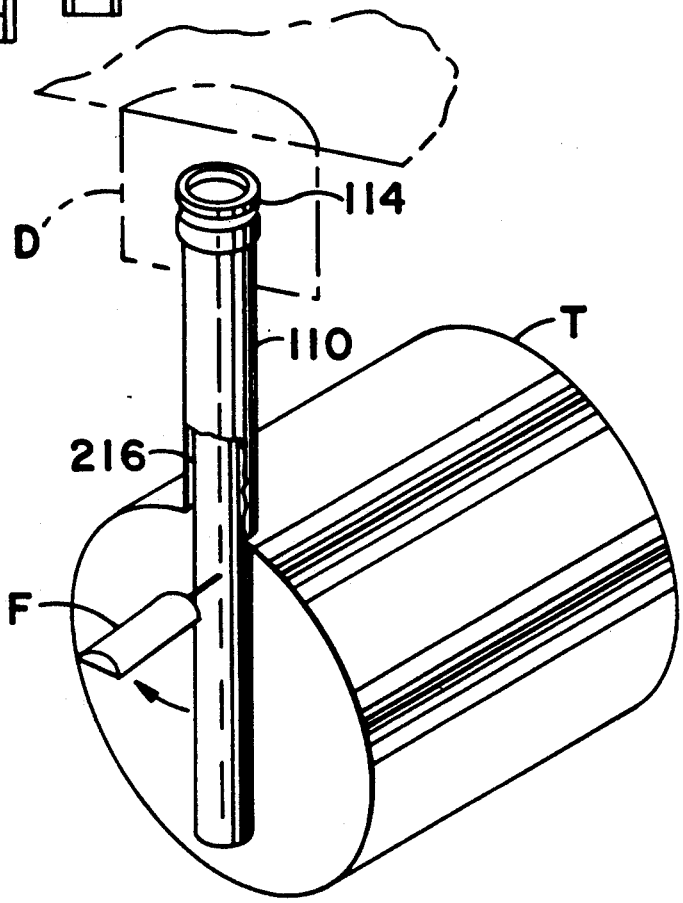
FIG. 6 is a small scale perspective view, illustrating the mounting of a drop tube/overfill valve unit in a storage tank.

FIG. 6 illustrates the environment of the present invention, where a drop tube 216 incorporates an overfill valve for shutting off flow of fuel into the storage tank, when the fuel level approaches the top of the tank. Of specific reference are overfill valves of the type which comprises a pivotally mounted float F. To actuate the shut off function the float must be pivoted to a horizontal position by the level of liquid, as the liquid is loaded into the tank. In order to actuate the shut off function when the tank is some 95%, or more, full, it is necessary, due to the length of the float, that the plane in which the float pivots be substantially aligned, in a vertically sense, with the axis of the cylindrical tank T, so that float movement won't be limited by the circular wall of the tank. Overfill valves of the type herein contemplated are found in U.S. Pat. No. 4,667,711 - Roger A. Draft.

Figure 5:
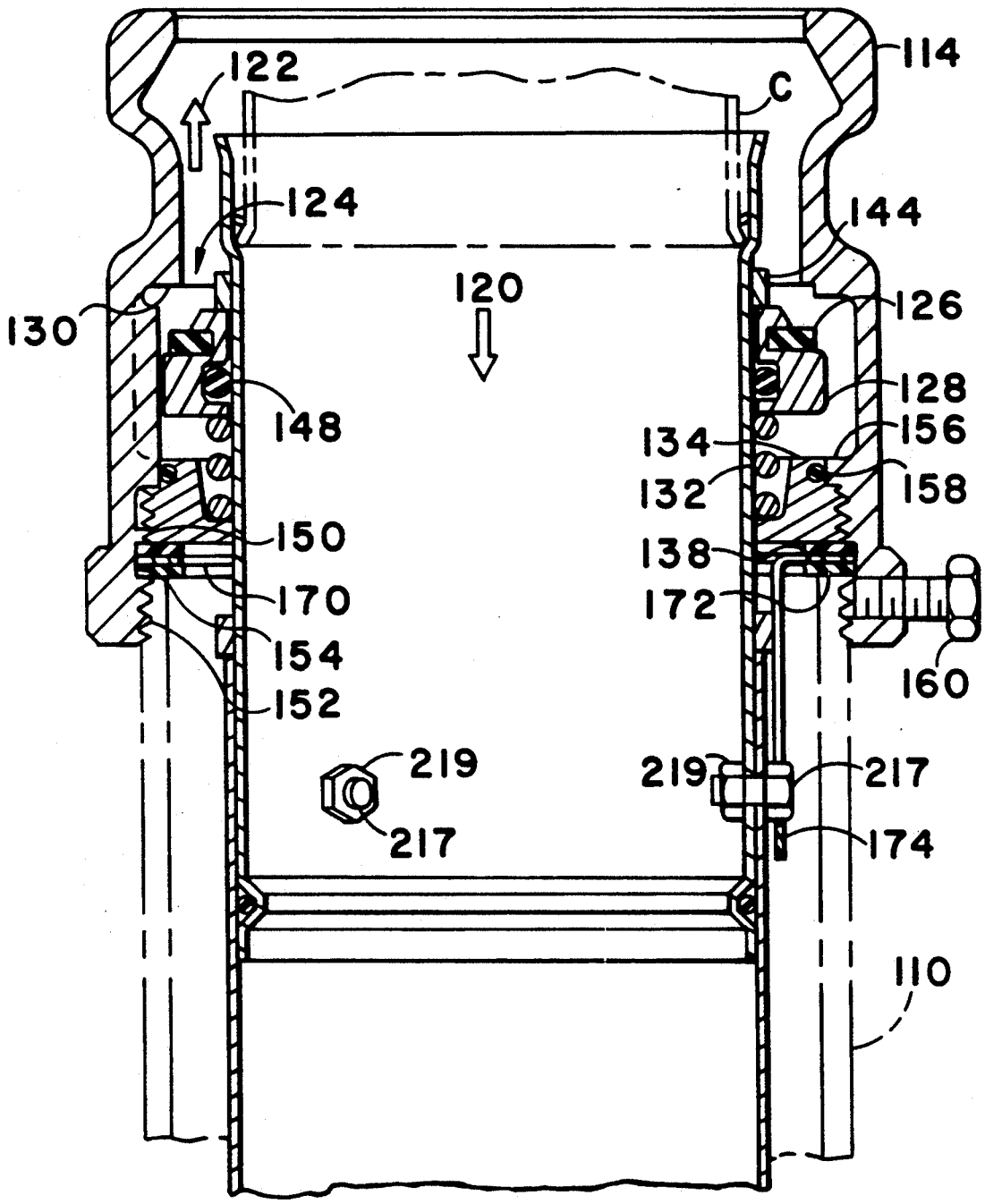
FIG. 5 is a longitudinal section of the drop tube/adapter unit of FIG. 4 illustrating the vapor valve in its open position and also illustrating the provision of means for maintaining a desired angular relation between the drop tube and a riser pipe.

FIG. 5 illustrates the adapter/drop tube unit of FIG. 4 employed in mounting an overfill valve. The components of this unit are essentially the same as previously described. FIG. 5 additionally illustrates the valve 124 in its open position, with the coupler tube C shown in sealed relation with and displacing the drop tube 216 downwardly.

The only differences are that the adapter recess 154' and the drop tube 216. The recess has a greater height for purposes that later appear. The upper portion of the drop tube 216 is attached to the lower portion (which includes the overfill valve) by bolts 217 and nuts 219, which serve functions beyond that of attachment means.

The upper portion of the drop tube 216 is assembled with the adapter 114 as previously described. Sealing ring 138, locator ring 170 and a second sealing ring 172 are telescoped over the lower end of the upper portion of the drop tube 216. The lower portion, including the overfill valve is then attached by the nuts and bolts, 217, 219.

Figure 7:
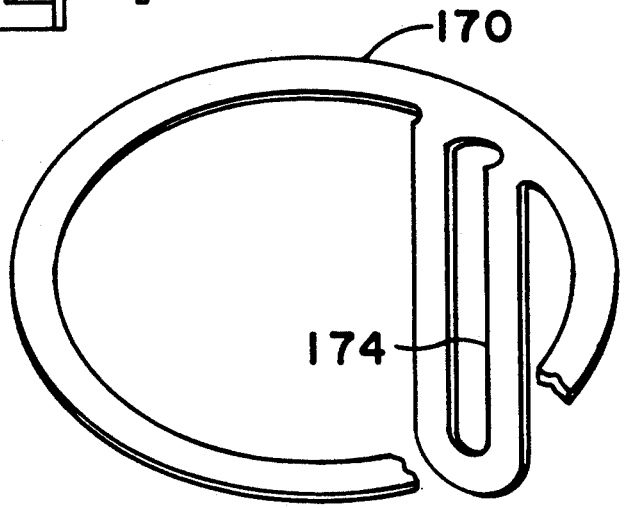
FIG. 7 is a perspective view, on an enlarged scale, of a locking ring employed in maintaining a desired angular relation between the drop tube and riser pipe.

The locator ring 170 has a depending guideway 174, FIG. 7, which receives the head of one of the bolts 217. The sealing ring 138, locator ring 170 and sealing ring are then disposed in the recess 154', the increased height of which accommodates the three elements. Alternatively, these elements could be assembled in the recess and the upper and lower portions of the drop tube 216 then assembled with the bolts 217 and nuts 219, with the head of one of the bolt 217 disposed in the guideway 174.

This assembly is then mounted on the riser pipe 10 by inserting the drop tube 216 therethrough, as before. the adapter is then threaded onto the riser pipe 10, as indicated in FIG. 5, but not torqued to a locked position.

The drop tube 216 is then rotated to an angular position in which the plane of pivotal movement of the float F is generally aligned with the axis of the storage tank T. Such alignment may be obtained by visual observation. This is to say that elements of the overfill valve are visually observable to determine the plane of float movement. Similarly, it is possible to visually determine the direction of the axis of the tank T. Thus, by aligning these visually observable elements, it is possible to determine if the desired alignment of the float pivot plane has been obtained.

The nuts 219 provide a torquing means for rotating the drop tube 216 to the desired alignment position. Thus a torquing tube (not shown) may be inserted into the drop tube 216. The torquing tube is provided with notches for receiving the nuts 219. The torquing tube is first used to rotate the drop tube 216 to its aligned position. It is then employed to maintain this aligned position as the adapter 114 is rotated to lock it in fixed relation on the riser pipe 110.

It will be appreciated the guideway 174 is locked in fixed relation relative to the riser pipe 110, and the sealing rings 138, 172 provide a positive vapor seal between the upper end of the riser pipe 110 and the threaded connection with the adapter 114.

The described locator ring 170 thus prevents rotation of the drop tube 216 relative to riser pipe 110 and thereby maintains the float F positioned so that its plane of pivotal movement is aligned with the axis of the storage tank T. Thus, the desired float alignment will not be lost by torquing forces on the drop tube, which are encountered in connected a loading coupler to and disconnecting it from the adapter 114.

It will be briefly noted that anti-rotational means have been provided for the described prior art adapter/-drop tube units, when employed with an overfill valve. Such means, for maintaining a desired angular position of the float, involved the use of guide means mounted on the seal seat 28. The prior art means are not suitable for the present device because of the ability of the drop tube 216 to rotate relative to the seal seat 128.

Variations from the described embodiment will occur within the spirit and scope of the present invention, as set forth in the following claims.

Having described the invention, what is claimed and desired to be secured by Letters Patent of the United States is:

1. A drop tube and adapter unit intended to be mounted on a riser pipe extending upwardly from a liquid storage tank, said drop tube defining a fuel flow path for loading of liquid into the storage tank, said drop tube, adapter and riser pipe defining an annular vapor return flow path for returning vapors from the tank to a collection means, when a loading coupler is mounted on the adapter, a vapor valve disposed in the vapor return flow path, said vapor valve comprising a first valve member on said adapter, a second valve member on said drop tube, the orientation of said adapter being a function of the degree to which the riser pipe is out of plumb, the upper end of said drop tube being mounted on the adapter and suspending the drop tube in a plumb position, within the angular limits of the drop tube engaging a riser pipe which is substantially out of plumb, said drop tube being axially movable relative to said adapter and riser pipe, yieldable means urging the drop tube to a position bringing the second valve member into sealing engagement with the first valve member in a closed position of the vapor valve, said drop tube being displaceable to a position in which the vapor valve is open, when a loading coupler is mounted on the adapter, characterized in that one of said valve members is mounted for universal movement relative to the drop tube, and that the spring means provide a substantially uniform sealing force between the first and second valve members, when the adapter is out of a plumb orientation, whereby, if the riser pipe is out of plumb, the first and second valve members will be maintained in seated relation in the closed position of the vapor valve.

2. A drop tube and adapter unit as in claim 1, wherein the second valve member is mounted for universal movement relative to drop tube, the yieldable means comprise a spring support axially movable with respect to the drop tube and secured in fixed relation on said adapter when the adapter is mounted on a fill pipe, and a compression spring acting between said second valve member and said spring support to urge the second valve member upwardly.

3. A drop tube and adapter unit as in claim 2, wherein the drop tube, in the area of the second valve member has a circular cross section, the first valve member is a horizontally disposed, annular seat formed on the adapter, and further characterized in that the second valve member comprises an annular seal seat ring having an inner diameter greater than the diameter of the drop tube, thereby providing universal movement between the ring and the drop tube, stop means, secured to the drop tube, limits upward movement of the seal seat ring, in response to urging of said compression spring, relative to the drop tube, and sealing means are provided between the seal seat ring and the drop tube.

4. A drop tube and adapter unit as in claim 2, wherein the adapter, at its lower end, includes a threaded portion for mounting the adapter/drop tube unit on a riser pipe, and further characterized by means for positively securing said spring support on said adapter in fixed relation to said first valve member, and a recess, disposed between said threaded portion and said spring support, for positioning a sealing ring which will be compressed between the spring support and the upper end of the riser pipe, when the adaptor is mounted thereon.

5. A drop tube and adapter unit as in claim 4, wherein the means for positively securing the spring support in fixed relation include abutment means formed on said adapter and a second threaded portion, engaged by the spring support, disposed above said recess.

6. A drop tube and adapter unit as in claim 5, wherein the second threaded portion is a continuation of the threaded portion for mounting the adapter on the riser pipe, and the spring support has a threaded portion with a height sufficient to bridge the recess between the threaded portions.

7. A drop tube and adapter unit intended to be mounted on a riser pipe extending upwardly from a liquid storage tank, said adapter having, at its lower end, a threaded portion for mounting the adapter/drop tube unit on a riser pipe, said drop tube defining a fuel flow path for loading of liquid into the storage tank, said drop tube, adapter and riser pipe defining an annular vapor return flow path for returning vapors from the tank to a collection means, when a loading coupler is mounted on the adapter, a vapor valve disposed in the vapor return flow path, said vapor valve comprising a first valve member on said adapter, a second valve member on said drop tube, said drop tube being axially movable relative to said adapter and riser tube yieldable means urging the drop tube to a position bringing the second valve member into sealing engagement with the first valve member in a closed position of the vapor valve, said yieldable means comprising a compression spring and a spring support, said drop tube being displaceable to a position in which the vapor valve is open, when a loading coupler is mounted on the adapter, characterized by means for positively securing said spring support on said adapter in fixed relation to said first valve member, and a recess, disposed between said threaded portion and said spring support, for positioning a sealing ring which will be compressed between the spring support and the upper end of the riser pipe, when the adaptor is mounted thereon, wherein said means for positively securing the spring support in fixed relation include abutment means formed on said adapter and a second threaded portion, engaged by the spring support, disposed above said recess.

8. A drop tube and adapter unit as in claim 7, wherein the second threaded portion is a continuation of the threaded portion for mounting the adapter on the riser pipe, and the spring support has a threaded portion with a height sufficient to bridge the recess between the threaded portions.

9. A drop tube and adapter adapted to be assembled and then mounted on a riser pipe extending upwardly of a liquid storage tank to provide a central liquid flow path for loading liquid into the storage tank and an annular vapor return flow path for liquid displaced from storage tank, and further to provide a vapor valve for sealing the vapor return flow path when a loading operation is not in progress, said vapor valve comprising a first valve member on said adapter and a second valve member mounted on said drop tube, spring means disposed beneath said second valve member, a spring support disposed beneath said spring means, means for securing said spring support to said adaptor with the second valve member urged upwardly into sealing engagement with the first valve member by the spring means, characterized by means precompressing said spring means prior to securing the spring support to the adapter, said means also positioning the spring support for engagement of the means for securing the spring support to said adapter.

10. A drop tube and adapter as in claim 9 further characterized in that the means for securing said spring support comprise threaded portions, respectively, on the adapter and spring support, and the spring is precompressed to a position in which the threaded portion on the spring support can be engaged with the threaded portion on the adapter prior to engagement of the second valve member with the first valve member.

11. A drop tube and adapter as in claim 10, wherein the adapter has, at its lower end, a threaded portion for mounting the adapter on a riser pipe, further characterized by a recess in said adapter, disposed between the threaded portion engageable by said spring support and the threaded portion for mounting the adapter on the riser pipe, for positioning a sealing ring which will be compressed between the spring support and the upper end of the riser pipe, when the adaptor is mounted thereon.

12. A drop tube and adapter as in claim 11, further characterized in that the threaded portion on the adapter, which receives the threaded portion of the spring support, is a continuation of the riser pipe receiving threaded portion, and the threaded portion of the spring support has a height sufficient to bridge the recess between the threaded portions.

13. A drop tube and adapter as in claim 12, wherein the first valve member is a horizontally disposed, annular seat formed on the adapter, and further characterized in that the second valve member comprises an annular seal seat ring having an inner diameter greater than the diameter of the drop tube, thereby providing universal movement between the ring and the drop tube, stop means, secured to the drop tube, limit upward movement of the seal seat ring relative to the drop tube, sealing means are provided between the seal seat ring and the drop tube, and stop means, secured to the drop tube, limit downward movement of the spring support relative to the drop tube to precompress the spring between the annular seal seat and the spring support.

14. A drop tube and adapter as in claim 13 further characterized in that the stop means comprises rings secured to said drop tube.

15. A method of installing a drop tube and adapter on a riser pipe extending upwardly from a cylindrical, liquid storage tank, wherein the drop tube defines a fuel flow path for loading of liquid into the storage tank, and said drop tube, adapter and riser pipe defining an annular vapor return flow path for returning vapors from the tank to a collection means, when a loading coupler is mounted on the adapter, a vapor valve disposed in the vapor return flow path, said vapor valve comprising a first valve member on said adapter, a second valve member on said drop tube, wherein the drop tube is capable of being rotated relative to the first valve member and adapter, and wherein it is desired to establish a predetermined angular relation between the drop tube and the riser pipe to thereby align an overfill valve float with the axis of the storage tank;

said method comprising inserting the drop tube through the riser pipe and into the storage tank;

threadably attaching the adapter to the upper end of the riser pipe in loose manner permitting rotation of the drop tube relative to the adapter, rotating the drop tube to a desired angular relation relative to the riser pipe, providing locating means adapted to be clamped between the adapter and the riser pipe when the adapter is fully thread onto the riser pipe, said locating means being in fixed angular relation to the drop tube, said method further comprising the step of maintaining the drop tube in said desired angular position while further threading the adapter onto the riser pipe to secure the adapter in fixed relation on the riser pipe, with the locating means in a desired angular position relative to the riser pipe.

16. A drop tube and adapter unit mounted on a riser pipe extending upwardly from a liquid storage tank, said adapter having, at its lower end, a threaded portion for mounting the adapter/drop tube unit on a riser pipe, said drop tube comprising a relatively short, upper portion and a lower portion, which extends into the storage tank, said drop tube defining a fuel flow path for loading of liquid into the storage tank, said drop tube, adapter and riser pipe defining an annular vapor return flow path for returning vapors from the tank to a collection means, when a loading coupler is mounted on the adapter, a vapor valve disposed in the vapor return flow path, said vapor valve comprising a first valve member on said adapter, a second valve member on said drop tube, said drop tube being axially movable relative to said adapter and riser tube, yieldable means urging the drop tube to a position bringing the second valve member into sealing engagement with the first valve member in a closed position of the vapor valve, characterized by locating means comprising a vertical guideway clamped between the upper end of the riser pipe and the adapter and a locating member projecting from the drop tube and received in said guideway, whereby, the drop tube is locked in fixed angular relation relative to the riser pipe.

17. A drop tube and adapter unit as in claim 16, further characterized in that an annular recess is provided in the adapter above the threaded portion, the locating means comprises a structural ring disposed in said recess and said guideway projects inwardly from the structural ring and downwardly therefrom, and sealing rings disposed respectively above and below said structural ring.

18. A drop tube and adapter unit as in claim 17, further characterized in that the upper and lower portions of the drop tube are joined by nut and bolt means, which project inwardly of said drop tube to provide means through which a torquing force can be applied to said drop tube, said nut and bolt means also providing the locating member received by said guideway.

19. A drop tube and adapter unit as in claim 17, wherein said yieldable means comprising a compression spring and a spring support, said drop tube being displaceable to a position in which the vapor valve is open, when a loading coupler is mounted on the adapter, further characterized by means for positively securing said spring support on said adapter in fixed relation to said first valve member, and said recess being disposed between said threaded portion and said spring support.

* * * * *